US007634983B2

(12) United States Patent
Grant

(10) Patent No.: US 7,634,983 B2
(45) Date of Patent: Dec. 22, 2009

(54) FUEL INDUCTED AND INJECTED INLET RUNNERS FOR COMBUSTION ENGINE WITH FLOW MODIFIERS FOR SUBDIVIDING FUEL DROPLETS

(76) Inventor: Barry S. Grant, Route 1, Box 1900, Dahlonega, GA (US) 30533

( * ) Notice: Subject to any disclaimer, the term of this patent is extended or adjusted under 35 U.S.C. 154(b) by 38 days.

(21) Appl. No.: 11/762,095

(22) Filed: Jun. 13, 2007

(65) Prior Publication Data

US 2008/0308068 A1 Dec. 18, 2008

(51) Int. Cl.
*F02M 35/02* (2006.01)
*F02M 55/02* (2006.01)

(52) U.S. Cl. ..... 123/184.31; 123/470

(58) Field of Classification Search ..... 123/184.31, 123/456, 468, 469, 470
See application file for complete search history.

(56) References Cited

U.S. PATENT DOCUMENTS 4,112,899 A * 9/1978 Kramer ..... 123/557
4,308,835 A * 1/1982 Abbey ..... 123/439
4,570,602 A * 2/1986 Atkins et al. ..... 123/468
4,852,526 A * 8/1989 Brown ..... 123/184.42
4,858,570 A * 8/1989 Matsumoto et al. .... 123/184.31
4,889,082 A * 12/1989 Hitomi et al. ..... 123/184.31
5,002,030 A * 3/1991 Mahnke ..... 123/469
5,197,436 A * 3/1993 Ozawa ..... 123/456
5,353,767 A * 10/1994 Carbone et al. ..... 123/470
5,511,527 A * 4/1996 Lorraine et al. ..... 123/456
5,807,512 A 9/1998 Grant
5,809,972 A * 9/1998 Grant ..... 123/478
5,863,470 A 1/1999 Grant
6,120,007 A 9/2000 Grant
6,659,058 B2 * 12/2003 Ozeki ..... 123/184.34
2002/0053331 A1 * 5/2002 Ohsuga et al. ..... 123/184.31
2002/0170518 A1 * 11/2002 Hirano et al. ..... 123/184.31
2005/0005888 A1 * 1/2005 Brassell et al. ..... 123/184.31
2007/0137603 A1 * 6/2007 Rutschmann et al. .. 123/184.57

* cited by examiner

*Primary Examiner*—Thomas N Moulis
(74) *Attorney, Agent, or Firm*—Thomas, Kayden, Horstmeyer & Risley, LLP; George M. Thomas

(57) ABSTRACT

A fuel delivery system for an internal combustion engine includes induction conduits of effectively equal flow resistance for guiding separate air and fuel streams to each of the cylinders of the engine. Each induction conduit includes at its entrance a sleeve venturi for inducing fuel into the air stream and a booster venturi. A fuel injector applies fuel at high pressure to the booster venturi. Flow modifiers may be positioned in the venturi throat and down stream of the venturi for modifying the flow of the stream of air after the fluid has been induced and injected into the stream of air for further subdividing the fuel vapor for increased effect of combustion of the fuel and air mixture.

22 Claims, 4 Drawing Sheets

FUEL INDUCTED AND INJECTED INLET RUNNERS FOR COMBUSTION ENGINE WITH FLOW MODIFIERS FOR SUBDIVIDING FUEL DROPLETS

FIELD OF THE INVENTION

This invention concerns a fuel delivery system for internal combustion engines for high performance vehicles. More particularly, the invention concerns fuel induction and fuel injection of the streams of inlet air of an engine.

BACKGROUND OF THE INVENTION

High performance engines for racing vehicles and for other high performance engines require large volumes of air and fuel to be delivered accurately to the cylinders of the engine. In the past, various fuel injection and carburetion features have been developed to provide the proper mixture in the desired amounts for high performance.

For example, U.S. Pat. Nos. 5,807,512 and 5,809,972 disclose four barrel carburetors that include booster venturis known as venturi rings positioned in surrounding venturi sleeves. Fuel injectors supply liquid fuel under pressure to the booster venturis to help form a high velocity, low pressure air stream that is located within the venturi section of the surrounding venturi sleeves. The combination of the inner and outer venturis makes a high velocity, low pressure area where fuel is both drawn into and is injected into the air stream. The liquid fuel that is induced and injected into the air stream is transformed into a fog from cylinders of the high performance engine. Induction conduits extend from the carburetor to the inlet valves of the cylinders of the engine and direct the air/fuel mixture to the engine.

While the use of the booster venturis in this environment is beneficial and an improvement over the prior art, the induction conduits extending from the carburetor to the inlet valves of the engine usually are shaped differently from one another and usually are of different lengths that apply different resistance to the air/fuel streams so that it is likely the air and fuel will be delivered to the cylinders of the engine at different rates and at different timing.

Other high performance vehicles use direct fuel injection that can be positioned in the induction conduits on the sides of the engine so that a fuel injector supplies accurate amounts of fuel to the air stream moving through the induction conduit on one side of the engine while another fuel injector functions similarly for the induction conduit on the other side of the engine. Again, the different sizes and shapes of the end portions of the induction conduits that lead directly to the cylinders apply different resistance to the streams and tend to create different amounts and velocities and timing of air and fuel being delivered to the inlet valves of the cylinders. In some instances, the above noted problems of different sizes and shapes of induction conduits leading to the inlets of the cylinders of a high performance engine tend to cause the engine to surge at low speeds, particularly at idle speeds.

In addition, for high performance engines it is desirable to be able to supply a large and equal amount of fuel instantly at the same time to the air streams flowing to each of the cylinders of the engine to maximize the power generated by the engine. Also, it is desirable that the liquid fuel be reduced to its smallest droplet size in the air stream when the air/fuel stream reaches the combustion cylinder for optimum performance of the engine. The smaller the size of the fuel droplets, the more complete and rapid burning is achieved of the air/fuel suspension.

It is to the above-described problems and desires that this invention is directed.

SUMMARY OF THE INVENTION

Briefly described, the present invention comprises an air and fuel induction system for a high performance internal combustion engine for forming and delivering air/fuel streams of uniform volume and desired consistency to the individual cylinders of the engine. The embodiment of the induction system described herein is applied to the typical V-shaped engine, such as a V-8 or a V-6 engine, with a left bank of cylinders and a right bank of cylinders arranged in a V-shape. However, other types of engines may use the fuel delivery system of this invention.

The air/fuel delivery system may have an induction conduit for each cylinder of the engine. A sleeve venturi and a ring venturi may be positioned concentrically at the entrance of each induction conduit. A fuel injector feeds liquid fuel under pressure to the ring venturi. The shapes and positions of the sleeve venturi and the ring venturi cause areas of low pressure to be formed about both the inner surface and the outer surface of the ring venturi. Injection of the fuel at high pressure through the ring venturi into the space where low pressure has been developed allows the vehicle operator to deliver a large amount of fuel into the air stream in the low pressure area about the ring venturi. This combination of the large volume of fuel and the extreme pressure differential in the air stream results in significant breaking up of the larger droplets of fuel. Also, the long run of the air/fuel stream through the induction conduit further functions to break up the droplets of fuel, such that the droplets are of significantly smaller size as the air/fuel stream reaches the cylinder of the engine.

Each induction conduit functions as a carburetor with its low pressure developed about the ring venturi that tends to induce the flow of fuel through the ring venturi. Also each induction conduit functions as a fuel injector with the delivery of the fuel under high pressure from the fuel injectors through the ring venturi into the air stream. In one embodiment of the invention the inlet induction conduits are not combined with other induction conduits, and each induction conduit supplies its air/fuel stream individually to its cylinder. In other embodiments a single induction conduit may supply its air/fuel stream to two or even more cylinders with equal flow resistance of the branches of the induction conduit being substantially equal.

The induction conduits that carry the air/fuel streams to the cylinders preferably are straight along at least major portions of their lengths so as to minimize and equalize the surface resistance to the air/fuel streams passing there-through. However, because the inlet valves of a engine generally are not easily accessible in the engine compartment of a vehicle for receiving the straight induction conduits, bends in the induction conduits might have to be formed to deliver the air/fuel streams to the cylinders. But the induction conduits are made to have as much internal straight path as practical.

It is desirable that the induction conduits are long so that the fuel added to the air stream has more distance in which to break into smaller droplets.

The effective distance between the point of addition of fuel to the entrance of the induction conduits and the point of delivery of the air/fuel streams to the cylinders are substantially equal for all cylinders. In one embodiment the paths of movement of the air/fuel streams are elongated and are substantially rectilinear along major portions of the paths, reducing the number of turns and constrictions in the paths leading to the cylinders and lengthening the paths traveled by the air/fuel streams. This allows more opportunity for the fuel to be subdivided into finer droplets before the stream reaches the cylinders and for the stream to be cooled by the evaporation of the fuel in the air.

In some engines that operate at higher revolutions per minute, the induction conduits may be shorter to provide acceptable performance of the engine such as avoiding engine surge.

A sleeve venturi is positioned in each induction conduit, preferably at the entrance of the induction conduit, and a booster venturi is positioned in the passage of each sleeve venturi. The booster venturi may be a ring venturi. When an air stream is induced by the cylinders of the engine to move through the induction conduit, the ring of the booster venturi delivers fuel radially inwardly of its central opening so that the liquid fuel is at the center of the induction conduit and encounters a low pressure and fast air stream at the entrance of the induction conduit that vaporizes the fuel. A similar low pressure phenomenon takes place at the inner surface of the sleeve venturi that surrounds the ring venturi. The cumulative effect of the low pressures is that the venturi sleeves and the ring venturis generate high velocity low pressure zones in the air streams that enhance the vaporization of the fuel in the air streams.

As described in U.S. Pat. No. 5,863,470, the venturi sleeves that surround the booster venturi may be replaceable with different sized venturi sleeves for different sized applications, such as the mounting of the fuel delivery system to different sized engines, or using different size venturi sleeves in the same engine for balancing the flow of air/fuel to the engine.

The induction conduits extend individually from the venturis to the cylinders of the engine. The induction conduits preferably are similarly shaped and similarly sized so as to avoid non-uniform performance of the induction conduits.

In one embodiment of the invention, the induction conduits are positioned over the engine. The induction conduits have inlet openings positioned over the left bank of cylinders and their delivery openings in communication with the right bank of cylinders. Conversely, a second series of induction conduits is positioned over the engine with the inlet openings positioned over the right bank of cylinders and delivery openings in communication with the left bank of cylinders. The intermediate portions of the induction conduits preferably are substantially rectilinear so as to reduce the amount of surface friction applied to the air/fuel streams.

The configuration of the induction conduits may be optional to fit the space within the engine compartment of the vehicle or to protrude from the engine compartment as may be desirable.

One or more fuel supply plenums may extend along the engine, with the fuel supply plenums receiving fuel under pressure from a conventional fuel pump and supplying the pressurized fuel to each fuel injector.

In one embodiment of the invention, the induction conduits are arranged so that the first series of induction conduits that supply air/fuel streams to one side of the engine are positioned between some of the induction conduits of the second series of induction conduits that supply air/fuel streams to the other side of the engine, therefore forming a cross-over arrangement of alternate ones of the induction conduits.

The longer lengths of the induction conduits takes advantage of the cooling function of the evaporation of the fuel in the air of the air/fuel mixture as the air/fuel mixture travels through the induction conduits to the individual cylinders of the engine. The lower temperature of the fuel entering the engine at the delivery point of the inlet valve of the engine tends to increase the horsepower and performance of the engine.

The sleeve venturis, booster venturis and/or the induction conduits may include flow modifiers at their surfaces. The flow modifiers may include protrusions, reliefs and other shapes at the surfaces through which the air/fuel stream passes. For example, the flow modifiers may include several semi-spherical protrusions extending into the diverging portions of the venturis and into the air/fuel streams. The protrusions tend to cause a small change of direction of the fuel passing about the protrusions. The change of direction of the air/fuel stream tends to cause the droplets of fuel to subdivide into smaller droplets. The finer droplets tend to enhance the combustion of the air/fuel mixture in the cylinders of the engine. Other modifier shapes may create similar results of enhanced combustion.

A conventional carburetor is not required for the engine since the fuel induction system is able to deliver the desired air/fuel mixture to the engine individually through each induction conduit, thereby avoiding some of the more expensive features of a conventional carburetor.

The flow of air through the induction conduits may be controlled by butterfly valves located at the entrance to each induction conduit. The butterfly valves may be positioned at other locations along the length of the induction conduits.

Thus, it is an object of this invention to provide an improved fuel delivery system for an internal combustion engine that improves the performance of the engine.

Another object of this invention is to provide an air/fuel induction system that is simple in its construction, easy to maintain, and enhances the performance of the engine to which it is applied.

Another object of this invention is to provide an air induction system for an internal combustion engine whereby individual air induction conduits supply a mixture of air and fuel to each cylinder, with the air induction conduits being of effectively similar size and shape so as to provide air streams of consistent uniformity to the cylinders of the engine.

Another object of the invention is to provide air/fuel stream modifiers for subdividing the droplets of fuel in the streams, for enhancing the combustion of the air/fuel mixtures that reach the cylinders.

Other objects, features and advantages of the present invention will become apparently upon reading the following specification, when taken in conjunction with the accompanying drawings.

DETAILED DESCRIPTION

Figure 1:
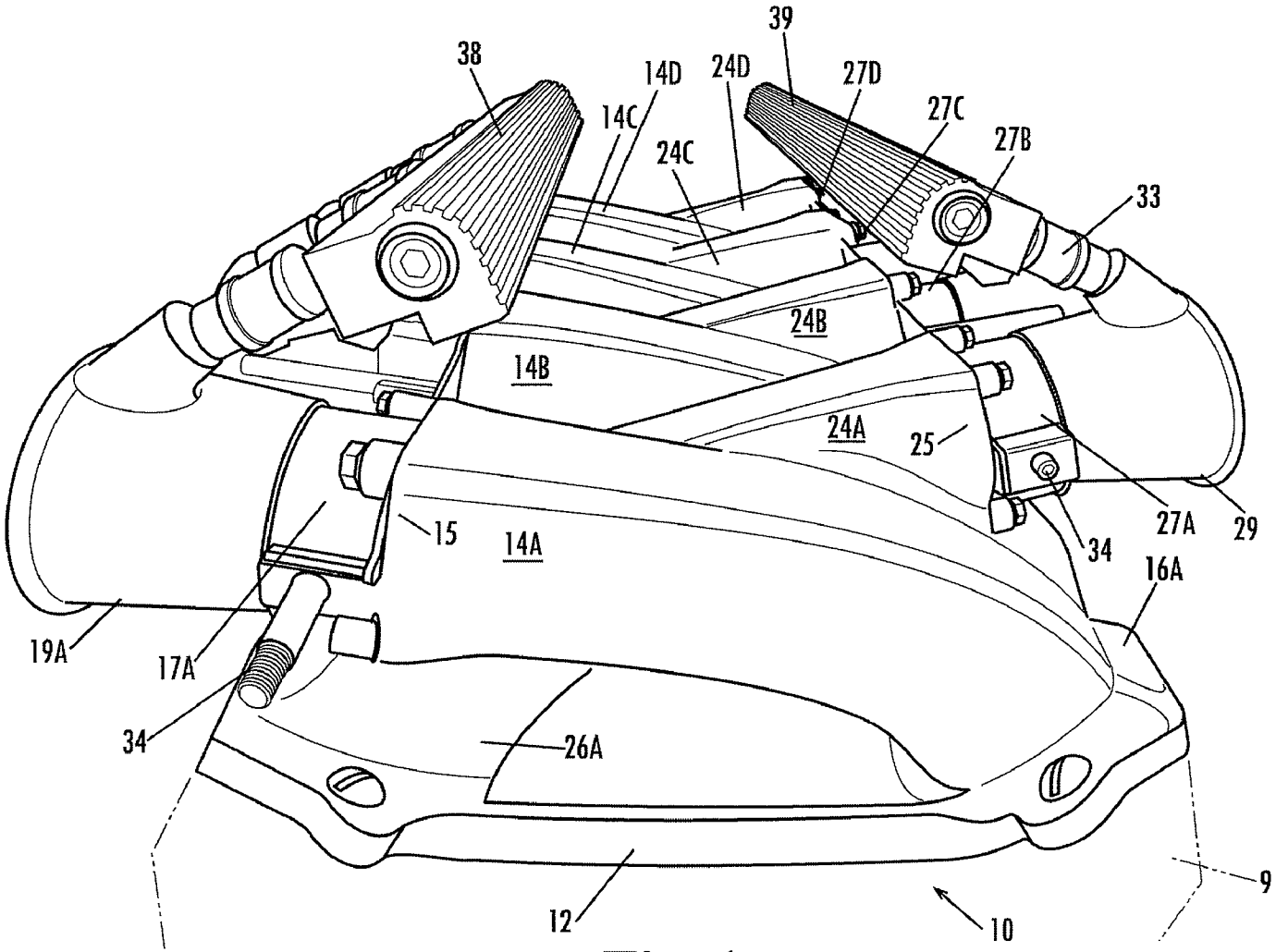
FIG. 1 is a front perspective view of the induction system for a V-8 internal combustion engine.

Referring now in more detail to the drawings, in which like numerals indicate like parts throughout the several views, FIG. 1 illustrates an induction system for a V-8 internal combustion engine. The induction system 10 is arranged so that it is to be mounted to the top surface of the engine 9. A base 12 is to engage the top surface of the engine, with appropriate bolts attached to the engine block.

A series of air induction conduits, generally known as "runners" are mounted on base 12. A first series of four induction conduits 14A, 14B, 14C and 14D are each open-ended induction conduits, with each having an entrance end 15 and a delivery end 16. The entrance ends 15 are positioned over the left bank of cylinders of the engine and delivery ends 26 arranged for extending to the right bank of cylinders.

A second series of induction conduits 24A, 24B, 24C and 24D are positioned over the engine with the entrance ends 25 positioned over the right bank of cylinders of the engine and delivery ends 26 arranged for extending to the left bank of cylinders.

The induction conduits 14A-14D and 24A-24D are of substantially the same dimensions in length and breadth, and are of substantially the same shape in that they are generally rectilinear along a major portion of their lengths and gently curve downwardly toward the positions of the inlet valves of the cylinders of the V-8 engine.

Butterfly valve housings 17A, 17B, 17C and 17D are mounted adjacent the entrance ends 15 of the first series of induction conduits 14A-14D, whereas similar butterfly valve housings 27A-27D are mounted to the entrance ends 25 of the second series of induction conduits 24A-24D. Butterfly valves (not shown) are rotatably mounted in each of the butterfly valve housings, and valve control rods, such as valve control rod 34 of FIG. 1, extend through each of the butterfly valve housings 17A-17D and 27A-27D. The valve control rods 34 control the rotary position of each of the butterfly valves to which it is connected, and the butterfly valves control the movement of the air stream that is induced by the engine to flow through the induction conduits.

Throttle bodies 19A-19D and 29A-29D are mounted to the entrance ends 15 of each of the induction conduits 14A-14D and 24A-24D respectively, with the butterfly valve housings 17A-17D and 27A-27D interposed therebetween. The throttle bodies effectively extend the lengths of the induction conduits. Likewise, throttle bodies 29A, 29B, 29C and 29D are mounted to the entrance ends 25 of the induction conduits 24A-24D. The throttle bodies are approximately cylindrical and, together with the induction conduits and butterfly valve housings, form an open-ended passage through the induction conduits to the delivery ends 16A-16D and 26A-26D of the induction conduits, with the butterfly valves controlling the flow of the air streams therethrough.

Figure 2:
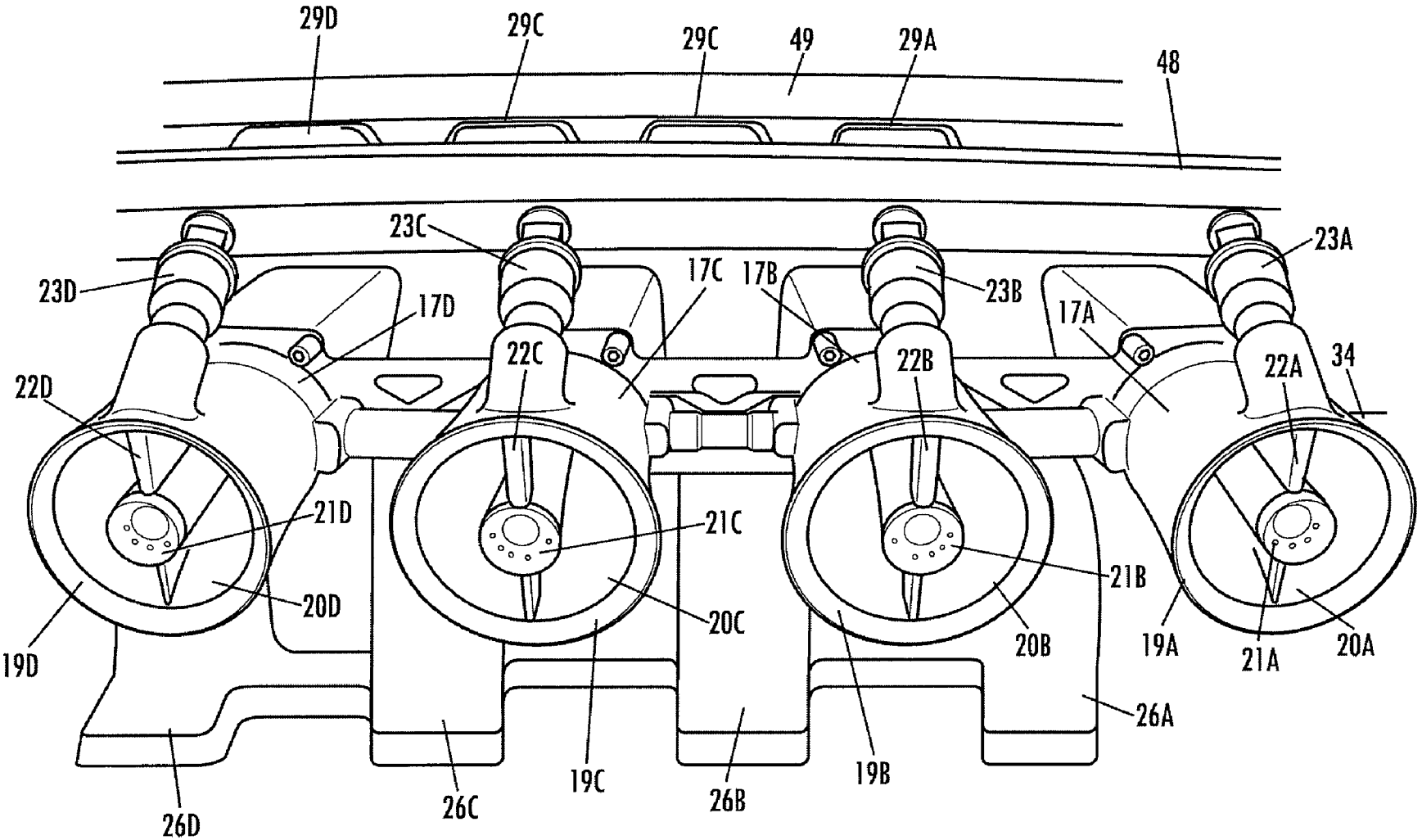
FIG. 2 is a side perspective view thereof.

Venturi sleeves, such as venturi sleeves 20A, 20B, 20C and 20D, of FIG. 2 are inserted in the throttle bodies 19A-19D and 29A-29D. The venturi sleeves each have an annular interior throat that converges and then diverges in breadth. The converging portion of the throat increases the velocity of the air stream and as the stream moves into the diverging portion of the throat, an area of reduced pressure is formed that is used to draw fuel into the stream. This mixes the air and fuel that forms the air/fuel stream moving through each of the induction conduits.

Ring venturis 21A-21D, sometimes known as booster venturis, are positioned in the throttle bodies 19A-19D and 29A-29D on each side of the engine. As shown in FIG. 2, the booster venturis 21A, 21B, 21C and 21D are positioned inside the venturi sleeves, such as venturi sleeves 20A-20D of FIG. 2. The booster venturis are circular, having converging and diverging inner surfaces as described above so as to increase and then decrease the velocity of air moving through the center portion of the booster venturis, thereby forming a zone of low pressure. As shown in FIG. 2, each booster venturi has a fuel inlet conduit 22A, 22B, 22C, and 22D that delivers fuel to the booster venturi, and as shown in FIGS. 3-6 the booster venturis include internally facing fuel ports 54 that spray fuel inwardly through the center opening of each booster venturi where an air stream travels. This functions to vaporize the fuel and spread the fuel throughout the air stream passing through the induction conduits.

FIG. 2 illustrates fuel injectors 23A, 23B, 23C and 23D that communicate through the throttle bodies 19A-19D and are in communication with the fuel inlet conduits 22A-22D of the booster venturis. Similar fuel injectors 33 communicate with the booster venturis (not shown) of the throttle bodies 29A-29D.

The fuel injectors are each in communication with a fuel supply plenum, such as the fuel supply plenum 38 that supplies fuel to the throttle bodies 19A-19D and the fuel supply plenum 39 that supplies fuel to its throttle bodies 29A-29D. The fuel supply plenums are elongated and are parallel to each other and extend over the induction conduits 14A-14D and 24A-24D, respectively. A fuel pump (not shown) feeds fuel to the fuel supply plenums.

The induction conduits 14A-14D and 24A-24D are all of the same length, for example approximately seven inches from their entrance ends 15 to the delivery ends 16, and are of similar breadth along their lengths. The booster venturis, such as booster venturis 21A-21D of FIG. 2, are positioned at the entrance to the throttle bodies, such as throttle bodies 19A-19D, adding another approximately three inches in length from the entrance of the fuel into the air stream to the delivery of the fuel at the delivery end of the induction conduits. This length is chosen to provide a cooling effect of the vaporization of the fuel in the air stream, tending to maintain the induction conduits cooler and to supply the cool mixture of fuel and air to the individual cylinders of the engine (not shown), thereby tending to raise the output of the engine. However, induction conduits of different dimensions may be used as may be desired, particularly when the induction system is to be applied to different sized engines.

The fuel delivery system 10 may be adjusted to be compatible with different sized engines by substituting different sizes of venturi sleeves, such as sleeves 20A-20D of FIG. 2. In some instances, when radical size changes are made, the booster venturis can be formed in different sizes for compatibility with different engine sizes.

The induction system is constructed to be compatible in shape and fit with the more popular high performance engines so that the existing carburetor or fuel induction system and the runners of an engine can be removed and the induction system disclosed herein can be directly attached to the engine.

The induction conduits 14 and 24 are shown as being formed in an interleaved relationship, with the induction conduits 14A-14D of the first series of induction conduits being positioned between the induction conduits 24A-24D of the second series of induction conduits. This enables the induction conduits to be long and have a substantially low profile, with interiors that are rectilinear along a major portion of the lengths thereof, and with the fuel supply plenums 48 and 49 positioned parallel to one another and spaced above the engine. Also, the lengths of the induction conduits can be varied without moving them to another position so that longer or shorter lengths may be utilized as may be desired.

Another feature of the invention is the use of the booster venturis receiving fuel from fuel injectors and delivering fuel under a desired high pressure directly into the induction conduits, feeding directly into the cylinders of the engine. This has the potential of placing the booster venturis, which is a source of fuel for the induction conduits, at almost any distance from the cylinders, with each cylinder being fed fuel from its own booster venturi. This tends to assure that the volumes of fuel fed to each cylinder are equal or are otherwise of a predetermined ratio to make sure that the amount of fuel is precisely controlled as the streams of fuel enter each cylinder of the engine.

While the drawings illustrate the induction conduits in a low profile crossover configuration, other configurations may be used. For example, the induction conduits may extend more upright, may be angled toward alignment with the length of the engine, or formed in other configurations that include substantially rectilinear segments for avoiding unnecessary surface friction applied to the air/fuel streams.

The term "air" is used to describe not only natural atmospheric air but also other oxygen bearing gasses, such as nitrous oxide.

More specific information concerning the booster venturis and the sleeve venturis is available in U.S. Pat. No. 6,120,007, the disclosure of which is incorporated by reference herein in its entirety.

As shown in FIGS. 3-6, flow modifiers can be used for the purpose of subdividing the liquid into smaller particles as the liquid flows with the air stream through the induction conduits to the cylinders of the engine. The flow modifiers can be of various shapes that function to modify the velocity of the air/fuel stream. The changes in speed and direction have an effect on the particle size of the liquid content of the air/fuel stream. More specifically, the droplets of fuel tend to subdivide into smaller droplets in response to the modification of the velocity of the air/fuel stream.

The flow modifiers can be positioned at various locations along the induction conduit, but an effective position is at the venturi throat of a venturi that induces or injects fuel into the air as the air flows through the venturi throat.

For example, FIGS. 3-6 each show a venturi throat with each of the figures showing different configurations of the flow modifiers.

Figure 3:
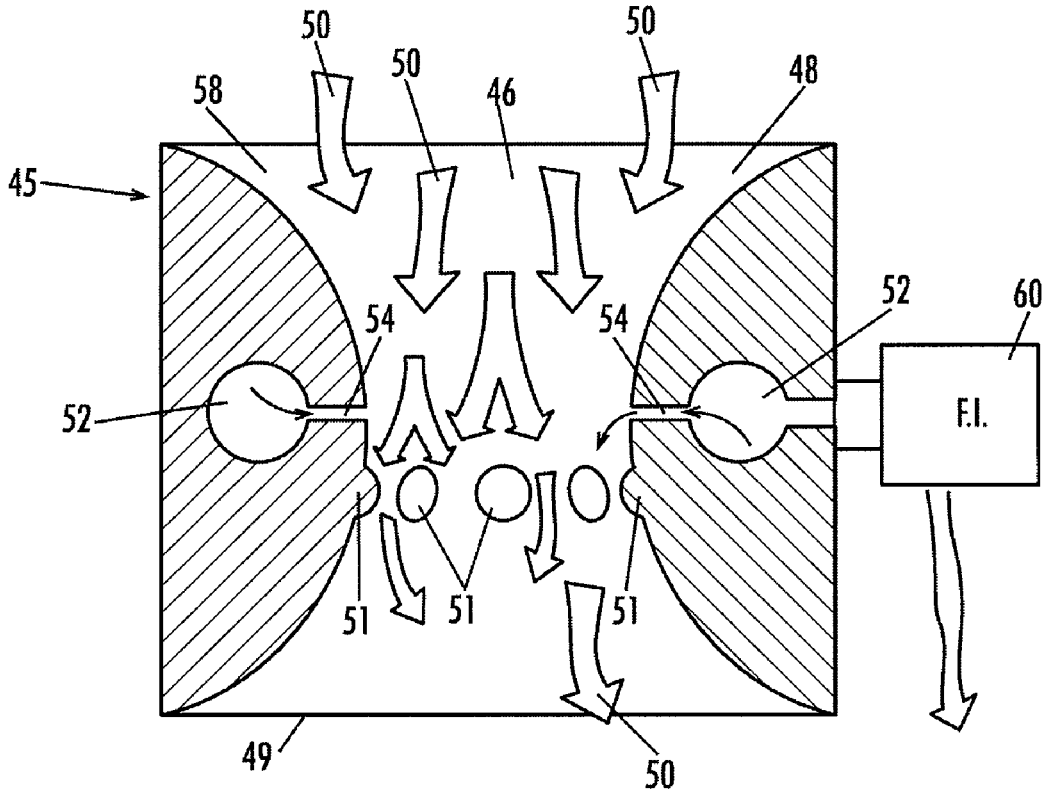
FIG. 3 is a cross section of a venturi that includes flow modifiers.

FIG. 3 shows a venturi 45 that includes a throat 46 having a converging portion 48 and diverging portion 49. The throat 46 is circular in horizontal cross-section and the air flowing through the venturi throat is illustrated by the arrows 50.

The venturi 45 includes a circular fuel passage 52 that surrounds the throat 46 and fuel delivery ports 54 extend from the circular fuel passage radially inwardly into communication with the throat 46.

Flow modifiers 51 are formed in the diverging portion 49 of the throat 46. In this embodiment, the flow modifiers are a ring of semi-hemispherical protrusions that are positioned about the diverging venturi surface and that extend into the space of the throat 46.

When air moves as indicated by the arrows 50 through the venturi throat 46, the high velocity air created in the converging portion 48 of the throat 46 begins to move into the diverging portion 49, causing a vacuum to occur at the fuel delivery ports 54. This induces an inward flow of liquid fuel from the circular fuel passage 52 and through the fuel delivery ports 54 into the stream of air. As the stream of air and fuel moves farther along the diverging portion of the throat 46, at least some of the air/fuel streams engage and/or are moved by the flow modifiers 51 so that the air/fuel streams tend to change in velocity, both in direction and in speed, causing a disruption of the shapes and volumes of the fuel droplets in the air. This disruption is minor but tends to subdivide the droplets into smaller droplets that are more desirable for combustion of the air/fuel mixture when reaching the cylinders of the engine. Moreover, the air/fuel mixture flowing adjacent but not directly engaging the flow modifiers 56 also tend to change in velocity, so that the droplets in these portions of the air/fuel stream tend to subdivide.

FIG. 3 is intended to describe a generic venturi in that it uses its vacuum to induce fuel to flow into the air stream. However, fuel injector 60 is used to create positive pressure of fuel moving into the circular fuel passage 52 and on through the fuel delivery ports 54. The higher pressure of the fuel entering the venturi throat 46 results in more volume of fuel being mixed with the air, and the flow modifiers 51 assist in subdividing the fuel droplets, disbursing the fuel within the air.

Figure 4:
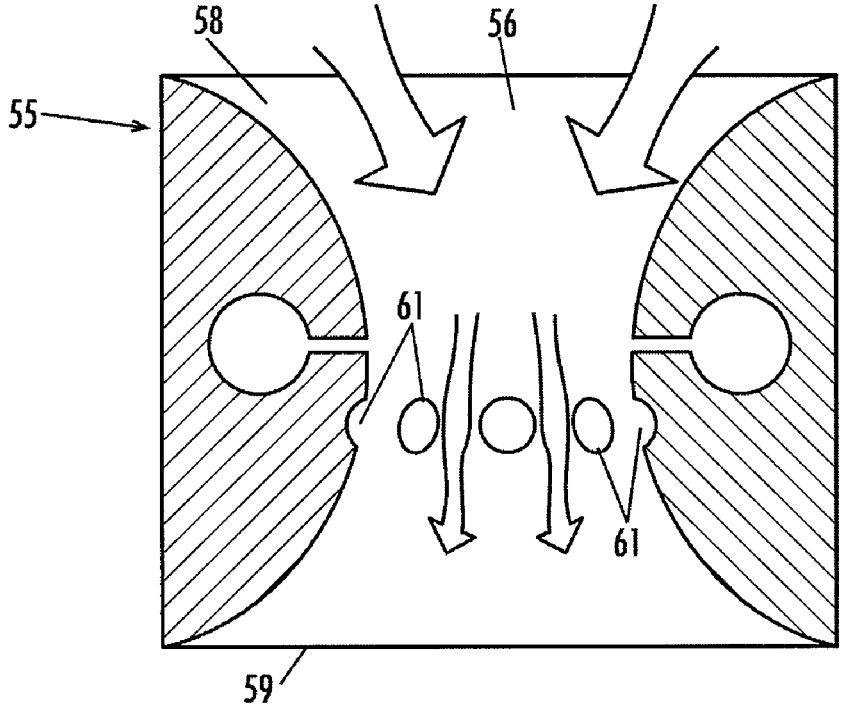
FIG. 4 is a cross section of a venturi that includes another type of flow modifier.

FIG. 4 shows another booster venturi 55, similar to that of FIG. 3, but showing flow modifiers that are detents 61 formed uniformly about the circular surface of the diverging portion 59.

The detents 61 tend to form a disruption in the air/fuel stream after the air stream has moved from the converging portion 58 into the diverging portion 59, thereby enhancing the subdividing of the fuel droplets and enhancing the performance of the fuel when it reaches the cylinder of the engine.

Figure 5:
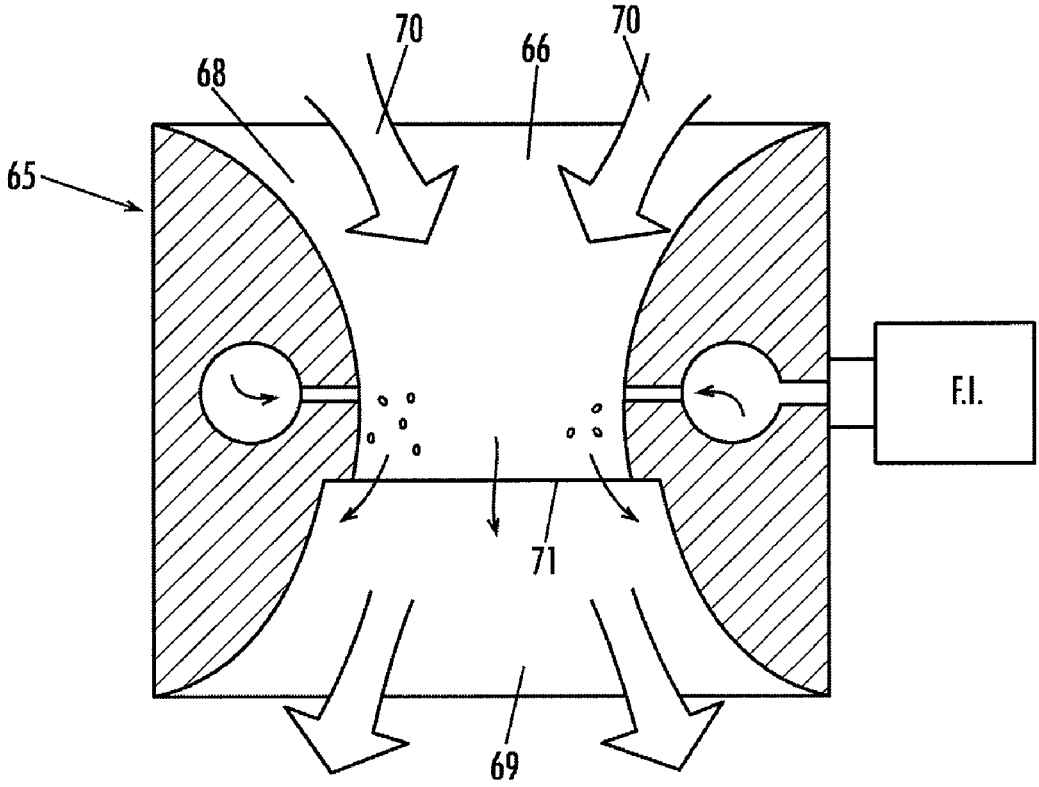
FIG. 5 is a cross section of a venturi that includes yet another type of flow modifier.

FIG. 5 is another embodiment of a venturi 65 that includes a throat 66 with a converging portion 68 and a diverging portion 69. A flow modifier 71 is formed in the throat 66, with the flow modifier being in the form of a circular outwardly facing shelf that changes the velocity of the air/fuel stream. This change in velocity tends to subdivide the droplets of fuel in the air/fuel stream moving as indicated by the arrow 70.

Figure 6:
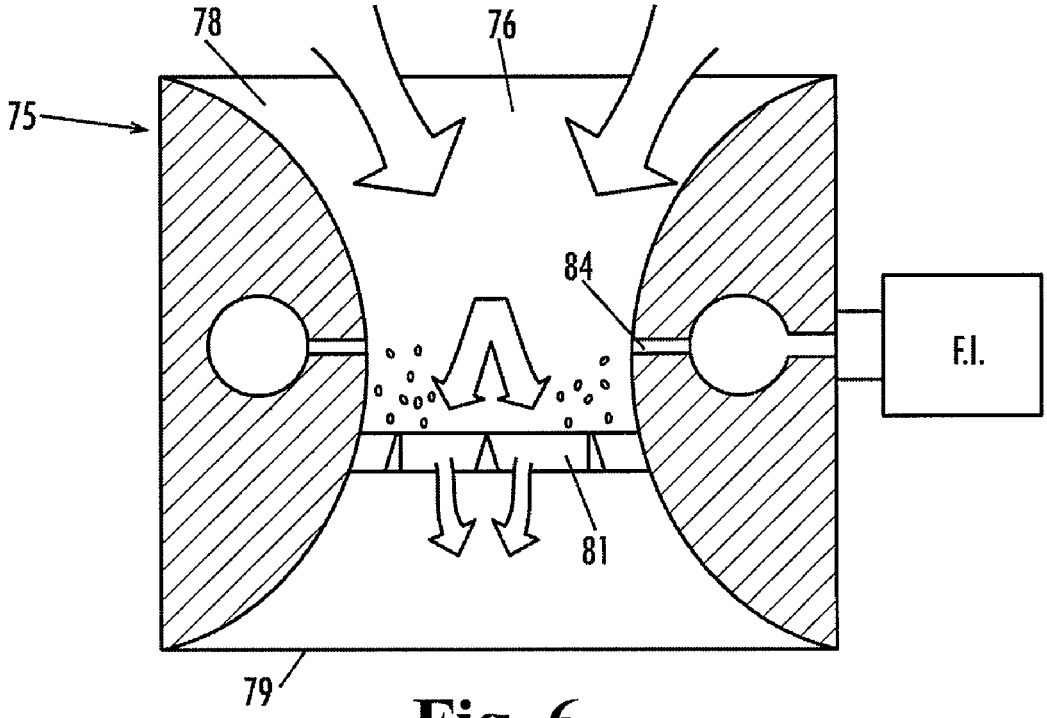
FIG. 6 is a cross section of a venturi that includes another type of flow modifier.

FIG. 6 illustrates another embodiment of a venturi 75 that includes a throat 76 with a converging portion 78 and a diverging portion 79. A flow modifier 81 is positioned down stream of the inlet ports 84 and is in the form of a grid that spans the throat 76. The grid tends to modify the velocity of the air and fuel moving in a stream through the throat, such that subdividing of the fuel droplets is achieved for better combustion results.

While the venturis 45, 55, 65, and 75 have all been illustrated in similar shapes, and while the flow modifiers have been positioned at the diverging portions of the venturi throats, it will be understood that various shapes and sizes of venturis can be employed for the purposes described herein. Moreover, the flow modifiers can be used in the other portions of the conduit system for the purpose of subdividing the droplets of fuel, thereby enhancing the combustion of the air and fuel in the cylinder. The venturis can be coupled with fuel injection or can be induction venturis, depending upon the requirements of the engine on which the venturis are to be used.

The flow modifiers preferably are of the types that would create minor disruption to the air/fuel stream, as opposed to abrupt turns, constrictions or large protrusions. The smaller sized flow modifiers have an effect on the subdividing of the fuel droplets and are preferable to larger obstructions so as to avoid unnecessary resistance to the flow of the fuel air stream through the induction conduit to the cylinders of the engine.

The term "air" is used to describe not only natural atmospheric air but also other oxygen bearing gasses, such as nitrous oxide. Also, while the invention of the flow modifiers has been described in connection with fuel and air for an internal combustion engine, the invention may be used to subdivide droplets of other liquids in other gas streams.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. An induction assembly for an internal combustion engine with a pair of banks of cylinders arranged in a V-shaped array of cylinders, including a left bank of cylinders and a right bank of cylinders, said induction assembly comprising:

a first series of induction conduits for positioning over the engine with inlet openings positioned at the left bank of cylinders and delivery openings in communication with the right bank of cylinders, each induction conduit of the first series of induction conduits configured to move an air/fuel stream to the inlet of one of the cylinders, a second series of induction conduits for positioning over the engine with inlet openings positioned at the right bank of cylinders and delivery openings in communication with the left bank of cylinders, each induction conduit of the second series of induction conduits configured to move an air/fuel stream to the inlet of one of the cylinders, a fuel injector supported at each of the induction conduits for injecting fuel into the induction conduits, and said fuel injectors each including an injector ring for mounting in the air streams, said fuel injectors including central venturi openings positioned substantially aligned with said induction conduits for the movement of streams of air there through, the injector rings including nozzles that direct fuel from the fuel injectors into the central venturi openings and into the streams of air moving through the central venturi openings, such that in response to the operation of the engine streams of air are drawn through the inlet openings of the induction conduits of both the first and second series of induction conduits and move over the engine and into the cylinders, and fuel is injected by the fuel injectors into the streams of air as the streams of air move through the induction conduits.

2. The induction assembly of claim 1, wherein flow modifiers are positioned in the central venturi openings for changing the velocity of flows of at least a portion of the streams of air moving through the central venturi openings.

3. The induction assembly of claim 1, and further including venturi sleeves positioned at the inlet openings of the induction conduits surrounding the injection rings.

4. The induction assembly of claim 3, wherein said fuel injection rings are positioned in said venturi sleeves.

5. The induction assembly of claim 2, with said venturi sleeves removably mounted in said induction conduit.

6. The induction assembly of claim 1 and wherein some of the induction conduits of the first series of induction conduits are positioned between some of the induction conduits of the second series of induction conduits.

7. The induction assembly of claim 1, wherein a first fuel supply manifold extends along and in communication with the fuel injectors of the first series of induction conduits, and a second fuel supply manifold extends along and in communication with the fuel injectors of the second series of induction conduits, such that fuel flows from the fuel supply manifolds through the fuel injectors on one side of the engine, through the induction conduits across to the other side of the engine and into the cylinders of the engine.

8. The induction assembly of claim 1, wherein the distances between the inlet opening and the delivery opening for each induction conduit are substantially the same.

9. An induction assembly for an internal combustion engine, the engine including a pair of banks of cylinders arranged in a V-shape, including a left bank of cylinders and a right bank of cylinders, a plurality of induction conduits, each induction conduit including an inlet opening and a delivery opening in communication with a cylinder of the engine for guiding streams of air to each cylinder of the engine, first alternate ones of the induction conduits having their delivery openings in communication with the cylinders of the right bank of cylinders, second alternate ones of the induction conduits having their delivery openings in communication with the left bank of cylinders, a fuel injector in communication with each of the induction conduits and for delivering fuel to each induction conduit, an injector ring, each injector ring including a central venturi opening position substantially centrally aligned with one of the induction conduits for the movement of air through the central venturi opening, and a nozzle in each of the annular injection ring for directing fuel from the injector rings into the central venturi openings and into the air moving through the central venturi openings, such that fuel is injected into the streams of air of each induction conduit, the induction conduits all having substantially rectilinear segments of substantially equal length for delivering the air/fuel in substantially equal rates to each cylinder of the engine.

10. An induction system for an internal combustion engine having a plurality of combustion cylinders, said induction system comprising:

an induction conduit for each combustion cylinder, each induction conduit defining an inlet for admitting an air stream and an outlet for mounting in fluid communication with a combustion cylinder, a fuel injector in fluid communication with each induction conduit for delivering fuel to the air stream passing through each induction conduit to its combustion cylinder, each fuel injector comprising an injection ring in alignment with the air stream of its induction conduit and a support stem supporting injection ring, the injection ring having an annular inner venturi surface with fluid openings therein, the induction conduits each including a rectilinear segment extending along at least a major portion of the length of the induction conduit downstream from the fuel injectors, with the rectilinear segments of the induction conduits being substantially equal in length, such that in response to the operation of the internal combustion engine air streams are induced in the induction conduits and zones of low pressure and high velocity air are formed in the injection ring of the fuel injectors and fuel is added to the air stream by the injection rings at the inner venturi surface and fuel is mixed with the air stream and the fuel is subdivided in the air stream during the movement of the fuel along the rectilinear segments of the induction conduits.

11. The induction system of claim 10, wherein the inner venturi surfaces of the injector rings include a flow modifier for changing the velocity of the air/fuel stream in the injector ring.

12. The induction system of claim 11, wherein the flow modifier includes a series of protrusions extending from the annular inner venturi surface of the injector ring.

13. The induction system of claim 11, wherein the flow modifier includes a series of detents formed in the annular inner venturi surface of the injector ring.

14. The induction system of claim 11, and further including a venturi sleeve surrounding the injector rings.

15. An induction system for an internal combustion engine having a plurality of combustion cylinders, the induction system including:

a plurality of induction conduits with each induction conduit configured for directing an air stream to one of the combustion cylinders of the engine, a venturi ring positioned in each of the induction conduits for forming an air/fuel stream, a flow modifier surrounding the air/fuel stream for changing the velocity of the air/fuel stream and dividing the droplets of fuel in the air/fuel stream, and the induction conduits being of effectively the same breadth and length from their booster venturis to their cylinders for guiding the air/fuel streams directly from the injector ring to the cylinders with substantially equal surface resistance applied to each air/fuel stream.

16. A fuel induction system for an internal combustion engine having a plurality of combustion cylinders, said induction system comprising:

an induction conduit for each combustion cylinder for delivering an air stream to each combustion cylinder, each induction conduit defining an inlet for admitting an air stream and an outlet for mounting in fluid communication with a combustion cylinder, a venturi sleeve positioned in each induction conduit for decreasing the pressure of each air stream of each induction conduit and for inducing a flow of fuel into the air stream of each induction conduit, a fuel injector in fluid communication with each induction conduit for delivering fuel to the air stream passing through each induction conduit to its combustion cylinder, each fuel injector comprising an injection ring in alignment with the air stream of its induction conduit and a support stem supporting injection ring, the injection ring having an annular inner venturi surface with fluid openings therein, such that in response to the operation of the internal combustion engine air streams are induced in the induction conduits and zones of low pressure and high velocity air are formed in the fuel injectors and fuel is added to the air stream at the inner venturi surface.

17. The fuel induction system of claim 16, wherein the induction conduits each include a flow modifier for changing the velocity of the air/fuel streams in the induction conduits.

18. The fuel induction system of claim 16, wherein the annular inner venturi surfaces of the injector rings each include a flow modifier for changing the velocity of the air/fuel streams in the injector rings.

19. The induction system of claim 18, wherein the flow modifiers are physical structures selected from the group consisting of: a ledge formed in the venturi throat, a plurality of protrusions formed about the venturi throat, a plurality of detents formed about the venturi throat, and a screen.

20. The induction system of claim 15, wherein the fluid induction port is sized and shaped to deliver a liquid to the venturi throat in droplets, and the flow modifier is shaped to divide the liquid droplets into smaller liquid droplets.

21. A method of inducing the flow of liquid into an air stream comprising:

drawing an air stream through a venturi throat, increasing the velocity of the air stream as it enters the venturi throat, decreasing the velocity of the air stream as it exits the venturi throat, inducing the flow of liquid into the air stream as the air decreases in velocity, and moving the air stream about an object in the venturi throat that changes the velocity of the air stream.

22. The method of claim 21, wherein the step of moving the air stream about an object comprises moving the air stream about an object selected from the group consisting essentially of: a ledge extending into the venturi throat, an array of protrusions extending into the venturi throat, an array of detents extending into the venturi throat, and a screen.

* * * * *